US008574070B2

(12) United States Patent
Neal

(10) Patent No.: US 8,574,070 B2
(45) Date of Patent: Nov. 5, 2013

(54) GAMING SYSTEM INCORPORATING A MULTI-DIRECTIONAL DISPLAY

(75) Inventor: Todd Lewis Neal, Snellville, GA (US)

(73) Assignee: Cadillac Jack, Duluth, GA (US)

( * ) Notice: Subject to any disclaimer, the term of this patent is extended or adjusted under 35 U.S.C. 154(b) by 1490 days.

(21) Appl. No.: 11/868,663

(22) Filed: Oct. 8, 2007

(65) Prior Publication Data

US 2009/0093303 A1 Apr. 9, 2009

(51) Int. Cl.
*A63F 9/24* (2006.01)

(52) U.S. Cl.
USPC ..... 463/31; 463/25

(58) Field of Classification Search
USPC ..... 463/1, 16–20, 25, 31
See application file for complete search history.

(56) References Cited

U.S. PATENT DOCUMENTS 7,537,522 B2 * 5/2009 Plavetich et al. ..... 463/36
2003/0166417 A1 * 9/2003 Moriyama et al. ..... 463/46
2005/0111100 A1 * 5/2005 Mather et al. ..... 359/464
2007/0197288 A1 * 8/2007 Fujimoto et al. ..... 463/31
2012/0028701 A1 * 2/2012 Gomez et al. ..... 463/25

OTHER PUBLICATIONS

Sharp Corporation, "Sharp Triple Directional Viewing LCD Offers Display of 3 Images", Press Release, Sep. 27, 2006, Japan.

* cited by examiner

*Primary Examiner* — William Brewster
*Assistant Examiner* — Jason Skaarup

(57) ABSTRACT

A gaming system includes a multi-directional display and a one-way mirror. The multi-directional display is configured to display a first visual image that is directly viewable along a central viewing axis, and to further display a second visual image that is directly viewable along a first angular viewing axis. The one-way mirror is positioned with reference to the multi-directional display for reflecting the second visual image along a second angular viewing axis while permitting direct viewing of at least a portion of the second visual image through the first one-way mirror along the first angular viewing axis.

20 Claims, 11 Drawing Sheets

GAMING SYSTEM INCORPORATING A MULTI-DIRECTIONAL DISPLAY

TECHNICAL FIELD

The technical field generally relates to gaming systems and specifically relates to a gaming system incorporating a multi-directional display.

BACKGROUND

Video games have become ubiquitous due to their universal appeal. Typically, these games are played on various products such as personal computers, hand-held personal devices, and dedicated gaming machines. Also typically, such products invariably incorporate a colorful electronic display supplemented with catchy sound effects. As can be understood, the electronic display plays a very critical role, both in terms of providing a visual interface that is appealing and user-friendly to a game player as well as in advertising the product.

In the era of the Internet, marketing personnel use a marketing parameter referred to as "capturing eyeballs," for quantifying the number of viewers that look at an electronic display and continue to look at the display over a period of time. While such marketing parameters are generally important with reference to world-wide web (www) advertisements, it is even more important in the video gaming industry where commerce plays a direct and more critical role than casual pleasure.

Typically, patrons of a video gaming establishment have short attention spans and are constantly seeking newer and flashier games to play. Unfortunately, many gaming establishments, for example gambling casinos, contain bank after bank of video gaming machines, each of which incorporates a display having a very predictable and conventional appearance that fails to capture eyeballs.

Furthermore, conventional gaming machines are generally configured to display marketing material such as prize money and game-related graphics, only when a gamer is not actively using the system. Unfortunately, this marketing information is withdrawn and replaced by a video gaming session when the gaming machine is in active use. Consequently, the effectiveness of the marketing effort is diminished significantly.

Based on the above-mentioned handicaps of existing display systems, an unaddressed need exists in the industry to overcome such deficiencies and inadequacies.

SUMMARY

A gaming system in one exemplary embodiment in accordance with the invention includes a multi-directional display and a one-way mirror. The multi-directional display is configured to display a first visual image that is directly viewable along a central viewing axis, and to further display a second visual image that is directly viewable along a first angular viewing axis. The one-way mirror is positioned with reference to the multi-directional display for reflecting the second visual image along a second angular viewing axis while permitting direct viewing of at least a portion of the second visual image through the first one-way mirror along the first angular viewing axis.

Clearly, some alternative embodiments may exhibit advantages and features in addition to, or in lieu of, those mentioned above. It is intended that all such alternative embodiments be included within the scope of the present invention, and be protected by the accompanying claims.

BRIEF DESCRIPTION OF THE DRAWINGS

Many aspects of the invention can be better understood with reference to the following drawings. The components in the drawings are not necessarily to scale. Instead, emphasis is placed upon clearly illustrating the principles of the invention. Moreover, in the drawings, like reference numerals designate corresponding parts throughout the several views.

DETAILED DESCRIPTION

The various embodiments in accordance with the invention are generally described below as systems and methods incorporating a multi-directional display for gaming purposes. Consequently, for the sake of expedience, the following description mostly refers to gaming systems that are typically utilized in establishments such as video game parlors and casinos. However, it will be understood that the methods and systems described herein are equally pertinent to many other applications, gaming as well as non-gaming, that incorporate such a multi-directional display. A few examples include gaming as well as non-gaming applications that are run on a personal computer (PC) and/or a hand-held device (e.g. a cellular phone, a personal digital assistant (PDA), and a dedicated gaming device). All such variants are therefore included within the scope of this disclosure.

Figure 1:
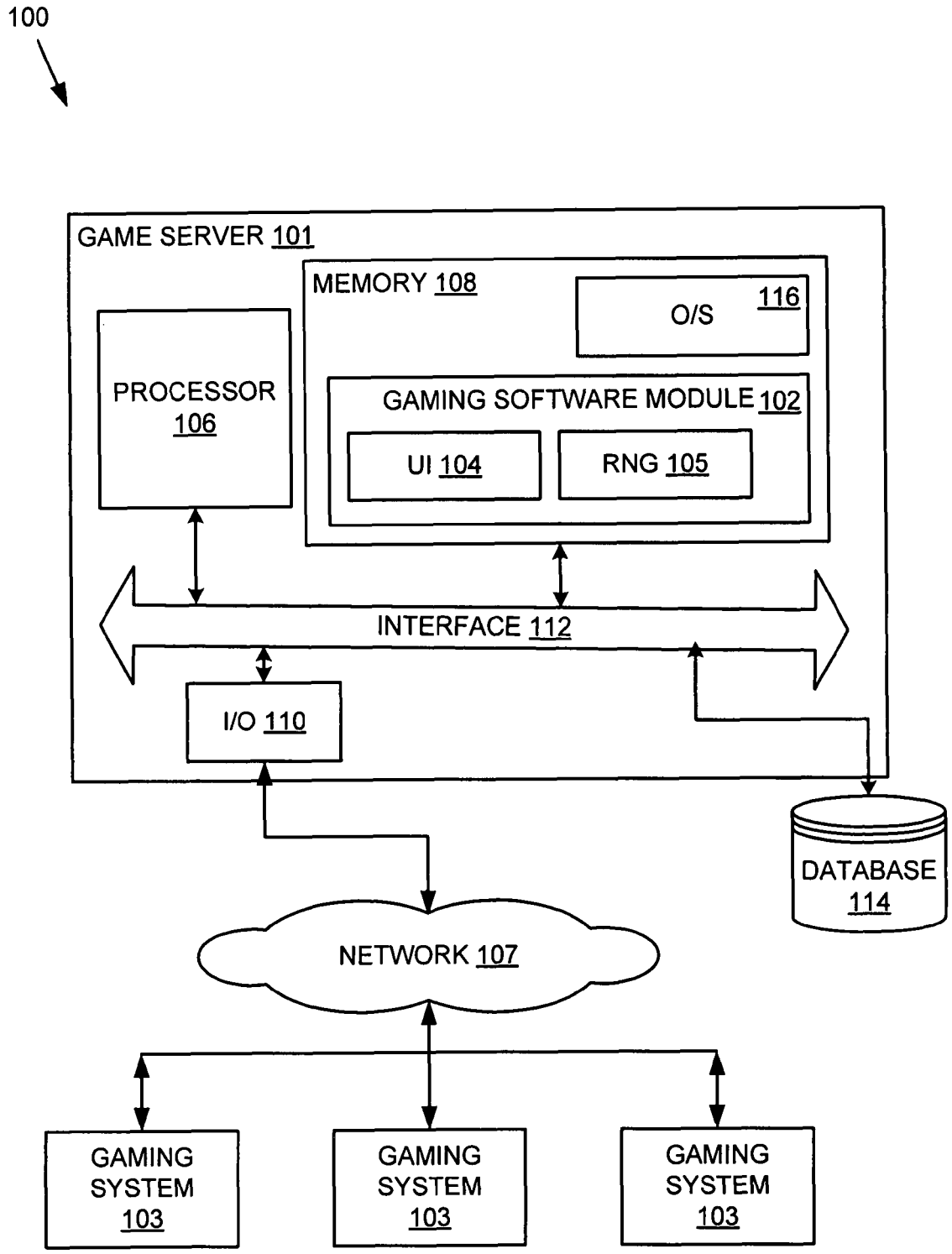
FIG. 1 shows an exemplary gaming network in accordance with the invention.

Attention is now drawn to FIG. 1, which shows an exemplary gaming network 100 in accordance with the invention. Gaming network 100 includes a game server 101 networked to a plurality of individual gaming machines 103 via a network 107 (e.g., a local area network (LAN) such as an Ethernet network, a wide area network (WAN) such as the Internet). Each gaming machine 103 may be located locally or remotely with respect to one another.

In this exemplary embodiment, game server 101 is shown as a centralized server implemented upon a special or general purpose digital computer, such as a personal computer (IBM, Apple etc.), a workstation, a minicomputer, or a mainframe computer. Game server 101 contains a gaming software module 102 that is used to communicatively couple gaming-related data to each gaming machine 103 via network 107. Among various components, gaming software module 102 includes a user-interface (UI) module 104 and a random number generator (RNG) 105. UT module 104 provides, in part, display functions according to well-known web-page or screen display generation and formatting mechanisms. RNG 105 includes one or more modules of code configured to determine whether to commence extended play, to define or initiate gaming parameters (and adjust one or more of such parameters) involved in implementing an extended play session, and to determine disbursement awards. Although shown integral to gaming software module 102, one having ordinary skill in the art would understand in the context of this disclosure that UI module 104 and/or RNG105 can be modules distinct from gaming software module 102, and that each module may be further configured using a plurality of submodules.

Generally, in terms of hardware architecture, as shown in FIG. 1, game server 101 includes a processor 106, memory 108, and one or more input and/or output (I/O) devices or peripherals 110 that are communicatively coupled to each other via a local interface 112. The local interface 112 can be, for example, one or more buses or other wired or wireless connections. The local interface 112 may have additional elements (not shown) to enable communications, such as controllers, buffers (caches), drivers, repeaters, and receivers. Further, the local interface 112 may include address, control, and/or data connections to enable appropriate communications among the aforementioned components. The game server 101 can also communicate with a database 114 via local interface 112. Local database 114 can be external to or integral to the game server 101.

Processor 106 is a hardware device capable of executing software, particularly that stored in memory 108. Processor 106 can be any custom made or commercially available processor, a central processing unit (CPU), an auxiliary processor among several processors associated with the game server 101, a semiconductor based microprocessor (in the form of a microchip or chip set), a macroprocessor, or generally any device for executing software instructions.

Memory 108 can include any one or combination of volatile memory elements (e.g., random access memory (RAM, such as DRAM, SRAM, SDRAM, etc.)) and non-volatile memory elements (e.g., ROM, hard drive, tape, CDROM, etc.). Moreover, memory 108 may incorporate electronic, magnetic, optical, and/or other types of storage media. Note that memory 108 can have a distributed architecture, where various components are situated remote from one another, but can be accessed by the processor 106.

The software in memory 108 may include one or more separate programs, each of which comprises an ordered listing of executable instructions for implementing logical functions. In one example of game server 101, the software in the memory 108 includes gaming software 102 and a suitable operating system (O/S) 116. Operating system 116 essentially controls the execution of other computer programs, such as gaming software 102, and provides scheduling, input-output control, file and data management, memory management, and communication control and related services.

Gaming software module 102 may contain a source program, executable program (object code), script, and/or any other entity comprising a set of instructions to be performed. When a source program, the program may be translated via a compiler, assembler, interpreter, or the like, which may or may not be included within memory 108, so as to operate properly in connection with the operating system 116. Furthermore, gaming software 102 can be written as (a) an object oriented programming language, which has classes of data and methods, or (b) a procedure programming language, which has routines, subroutines, and/or functions, for example but not limited to, C, C++, Pascal, Basic, Fortran, Cobol, Perl, Java, ASP, and Ada.

I/O devices 110 may include input devices such as a keyboard, mouse, scanner, microphone, etc., as well as interfaces to various devices. Furthermore, I/O devices 110 may also include output devices, such as a printer, display, etc. Finally, I/O devices 110 may further include devices that communicate both inputs and outputs, for instance a modulator/demodulator (modem for accessing another device, system, or network), a radio frequency (RF) or other transceiver, a telephonic interface, a bridge, a router, etc.

When game server 101 is in operation, processor 106 is configured to execute software stored within memory 108, to communicate data to and from memory 108, and to generally control operations of the game server 101 pursuant to the software. Gaming software 102 and operating system 116, in whole or in part, but typically the latter, are read by processor 106, perhaps buffered within processor 106, and then executed.

Gaming software 102 can be stored on any computer readable medium for use by or in connection with any computer related system or method. In the context of this document, a computer readable medium is an electronic, magnetic, optical, or other physical device or means that can contain or store a computer program for use by or in connection with a computer related system or method. Gaming software 102 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions.

Figure 2:
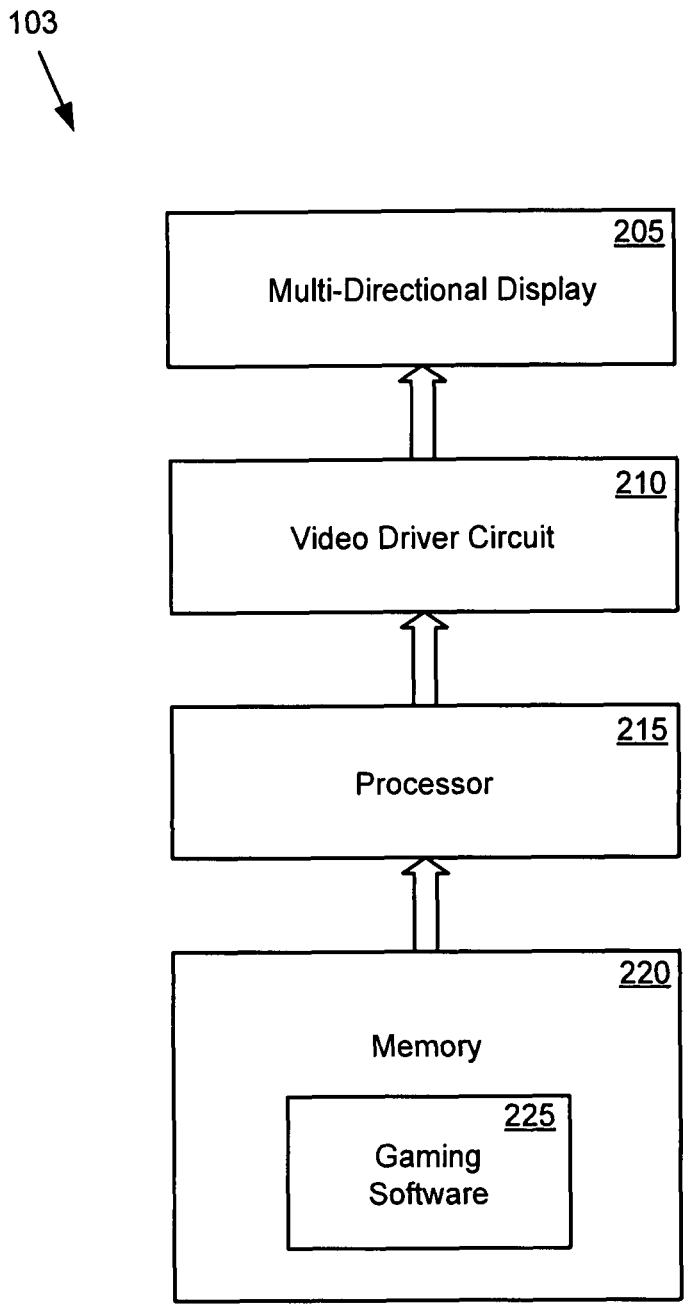
FIG. 2 shows an exemplary gaming system that is a part of the gaming network of FIG. 1.

FIG. 2 shows an exemplary gaming system 103 that is a part of gaming network 100 described above. When operated as part of server-based gaming network 100 incorporating multiple gaming systems, the outcome of game play may be determined centrally by game server 101. However, in an alternative embodiment, gaming system 103 is a stand-alone device, which is operated independent of a server, and the outcome of game play is determined locally. In either mode of operation, gaming system 103 may be used for gaming (e.g., gambling or redemption), amusement, competition, or other purposes.

The components of gaming system 103 may be identical to, or partially resemble, the components described above with reference to game server 101. Additionally, processor 215 is communicatively coupled to a video driver circuit 210, which provides suitable video drive signals to a multi-directional display 205. Normal operational aspects of video driver circuit 210 are known to persons of ordinary skill in the art and will not be described herein. However, certain specific operational aspects of video driver circuit 210 will be described below with reference to exemplary embodiments.

Multi-directional display 205 typically incorporates a parallax barrier (not shown) located in front of a thin film transistor (TFT) liquid crystal display (LCD) (not shown). This configuration splits light in two or more directions, whereby two or more different images are formed on the same LCD screen and each of these images can be simultaneously viewed from two or more different angles.

A first exemplary multi-directional display is disclosed in US Application Publication Number 2005/0111100 A1 titled "Multiple-View Directional Display," Mather et al. A second exemplary multi-directional display is a Triple Directional Viewing LCD that is commercially marketed by Sharp Corporation. The Triple Directional Viewing LCD may be installed in a vehicle for example, whereby the driver can view a first screen displaying navigation information. A passenger sitting beside the driver can simultaneously check out tourist sites and restaurants on the same LCD screen without interfering with the navigation view seen by the driver, while a passenger seated in the back can watch a movie also on the same LCD screen without interfering with the images seen by the other two occupants of the vehicle.

Processor 215 executes gaming software 225 stored in memory 220 and generates appropriate signals that are coupled into video driver circuit 210 for driving multi-directional display 205 for producing one or more images. In one embodiment, each of the multiple images is distinct from one another, while in another embodiment, a portion of a first image is combined with a portion of a second image. In yet another embodiment, an entire first image is combined with an entire second image. The image combining aspect will be described below in further detail using other examples.

Figure 3:
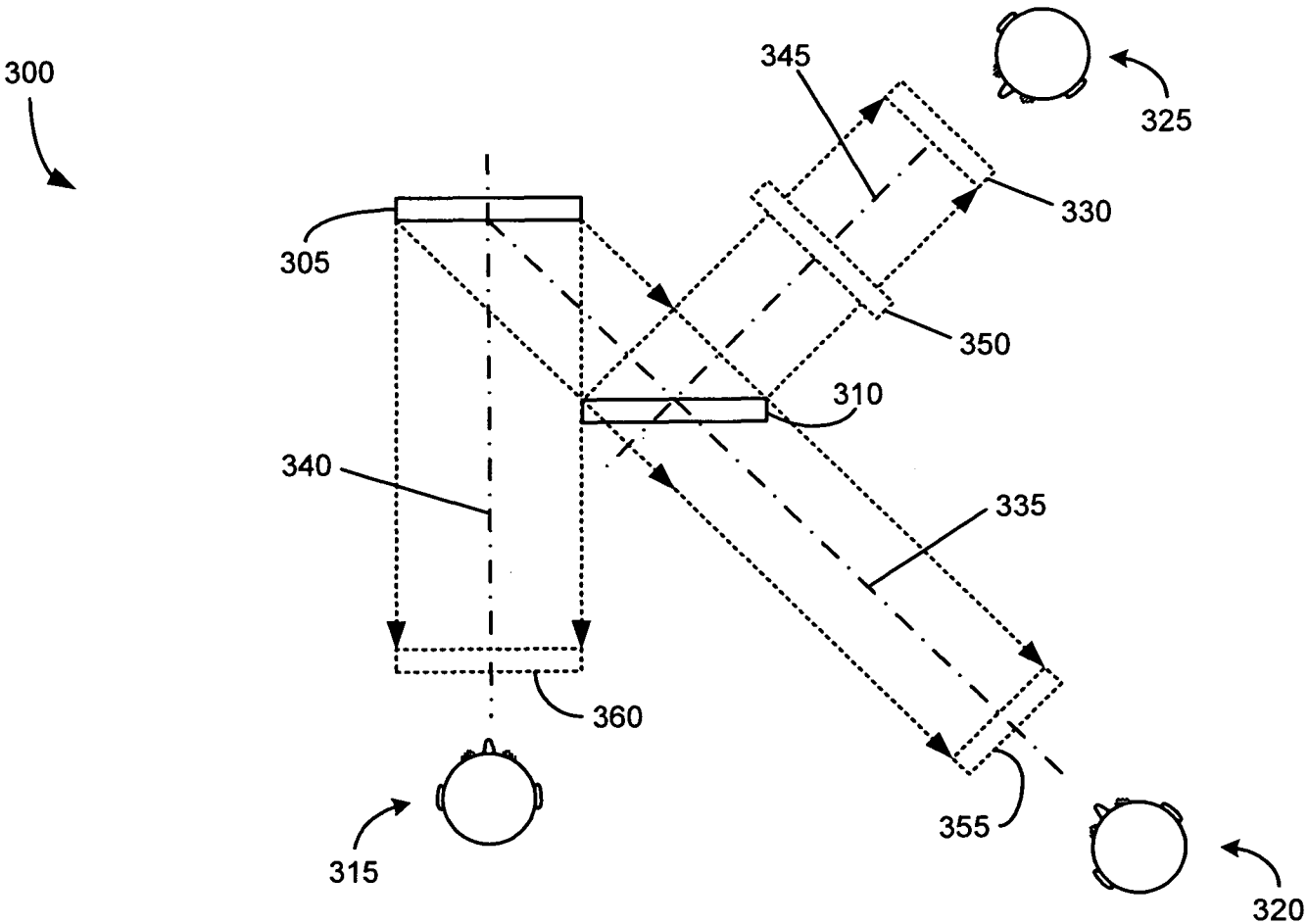
FIG. 3 shows a first exemplary embodiment of a gaming system containing a two-directional display and a one-way mirror, in accordance with the invention.

FIG. 3 shows a gaming system 300 that is a first exemplary embodiment of a gaming system in accordance with the invention. Gaming system 300 incorporates a one-way mirror 310 and a two-directional display 305. Two-directional display 305 is configured to generate two images upon an LCD screen (not shown) of two-directional display 305. One or both of these images may be 'static' images that do not change over a preset period of time, or may be 'dynamic' images such as those of a video clip. The two images are simultaneously viewable from two different viewing angles. One of the two viewing angles is defined in FIG. 3 by a central viewing axis 340, while the other is defined by a first angular viewing axis 335.

For purposes of description, the first image as perceived by a first person 315 is depicted in FIG. 3 by a dashed box that is hereinafter referred to as first image 360. It will be understood that the dashed box merely represents an image as effectively perceived, say in the retina/brain, of first person 315. In practice, the image is generated on the LCD screen of two-directional display 305 and light corresponding to this generated image travels along central viewing axis 340 towards first person 315.

A similar nomenclature will be used hereinafter for other images in FIG. 3 as well as other figures. Consequently, for example, a second dashed box of FIG. 3 depicts a second image 355 that is also a perceived image, as perceived by a second person 320. In actual practice, this image is also generated on the LCD screen of two-directional display 305 and light corresponding to this generated image travels along first angular viewing axis 335 towards second person 320.

One-way mirror 310 is positioned transversely to first angular viewing axis 335 such that a first portion of light emitted by two-directional display 305 and traveling along first angular viewing axis 335, is reflected along a second angular viewing axis 345 towards a third person 325, who may be a game observant for example. Third person 325 views a reflected image 330. Here again, the dashed box represents a perceived image as perceived by third person 325, while the actual reflected image is located on one-way mirror 310. A second portion of light emitted by two-directional display 305 propagates through one-way mirror 310 and continues to travel along first angular viewing axis 335 towards second person 320. Second person 320 may be an observant or a second game player.

The width of one-way mirror 310 may be adjusted in certain cases, such that second person 320 not only receives light propagated through one-way mirror 310 but also light transmitted directly from two-directional display 305, thereby seeing a first portion of the second image directly and a second portion of the second image through one-way mirror 310. Furthermore, in one exemplary embodiment, one-way mirror 310 is an adjustable mirror that may be suitably adjusted either by a game player or by a manufacturer of gaming system 300. The adjustment may be carried out manually or via a servomotor.

Lateral image inversion, as a result of reflection from a mirror, can be corrected in several ways. In a first example, image inversion can be rectified by using orientation-correcting optics, such as a lens system 350 that is interspersed between one-way mirror 310 and third person 325. Lens system 350 is operative to carrying out an image inversion whereby third person 325 can see reflected image 330 as a faithful copy of the second image 355 that is seen by second game player 320.

In a second example for correcting lateral image inversion, a video driver circuit, such as video driver circuit 210 of FIG. 2, can be configured to drive two-directional display 305 with suitable electronic signals that generate a laterally-inverted second image upon the LCD screen (not shown) of two-directional display 305. This laterally-inverted second image is inverted once again by one-way mirror 310, thereby allowing third person 325 to observe an accurately-oriented reflected image 330. In this configuration, second person 320 will be observing a laterally inverted image.

However, in certain cases, correction for image inversion may be redundant or unnecessary. Such cases relate to images having an image content that is laterally symmetric—for example a circular ball or a star pattern.

Gaming system 300 may be configured for various alternative applications. For example, in a first application, gaming system 300 is configured as a multi-player gaming system permitting two game players, first person 315 and second person 320, to play against each other. In this application, the first and second images generated on the LCD screen of two-directional display 305 are both related to a single game. When not in use for game playing, the two images may be adapted for marketing purposes using a marketing image that may be shared wholly or partially in the two views. Alternatively, two independent images may be displayed.

In a second exemplary application, gaming system 300 is configured as a single-player gaming system permitting first person 315 to solely participate in a game. In this application, the first image is a game-related image, while the second image is a marketing image directed to second person 320, who may be seated next to first person 315 or may be a passerby.

In a third exemplary application, both the first and second images are marketing images directed to first person 315 and second person 320 each of whom may be a game player or a casual observer. In this application, the marketing images may be identical to one another or may be two independent images.

Figure 4:
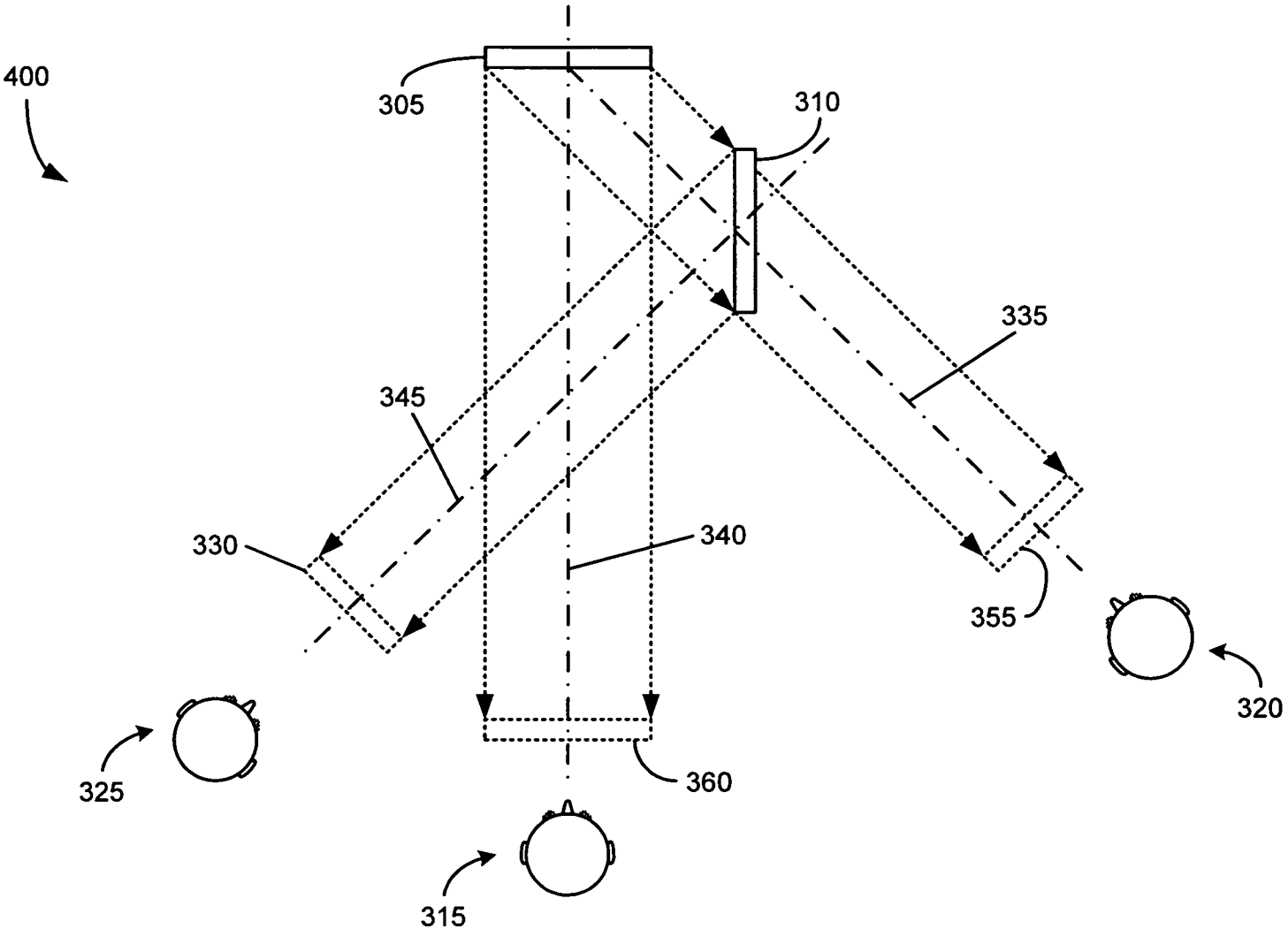
FIG. 4 shows an alternative exemplary embodiment of the gaming system of FIG. 3.

FIG. 4 shows a gaming system 400 that is an alternative exemplary embodiment of gaming system 300 of FIG. 3. In gaming system 400, third person 325, a game observer for example, is located beside first person 315 who is facing two-directional display 305. In this embodiment, one-way mirror 310 is oriented for reflecting light towards third person 325 along the same second angular viewing axis 345. However, in this case, the direction of light propagation towards third person 325 is opposite to that in gaming system 300 shown in FIG. 3. Furthermore, it will be understood that one-way mirror 310 may be manually or automatically positioned for either the configuration shown in FIG. 3 or the configuration shown in FIG. 4.

In yet another exemplary application, one-way mirror 310 may be alternatively positioned to direct a reflected image in any direction that is not necessarily along second angular viewing axis 345. This positioning may be carried out manually, or in one application by using a servomotor coupled to movement sensors that track movement of one or more passersby. The servomotor moves one-way mirror 310 so as to continuously display a marketing image to a passerby as the passerby walks past the gaming system.

In yet another exemplary application, one-way mirror 310 is a rotating mirror continuously driven by a servomotor. The rotation provides dynamic imagery, as is desirable in a gaming environment.

Figure 5:
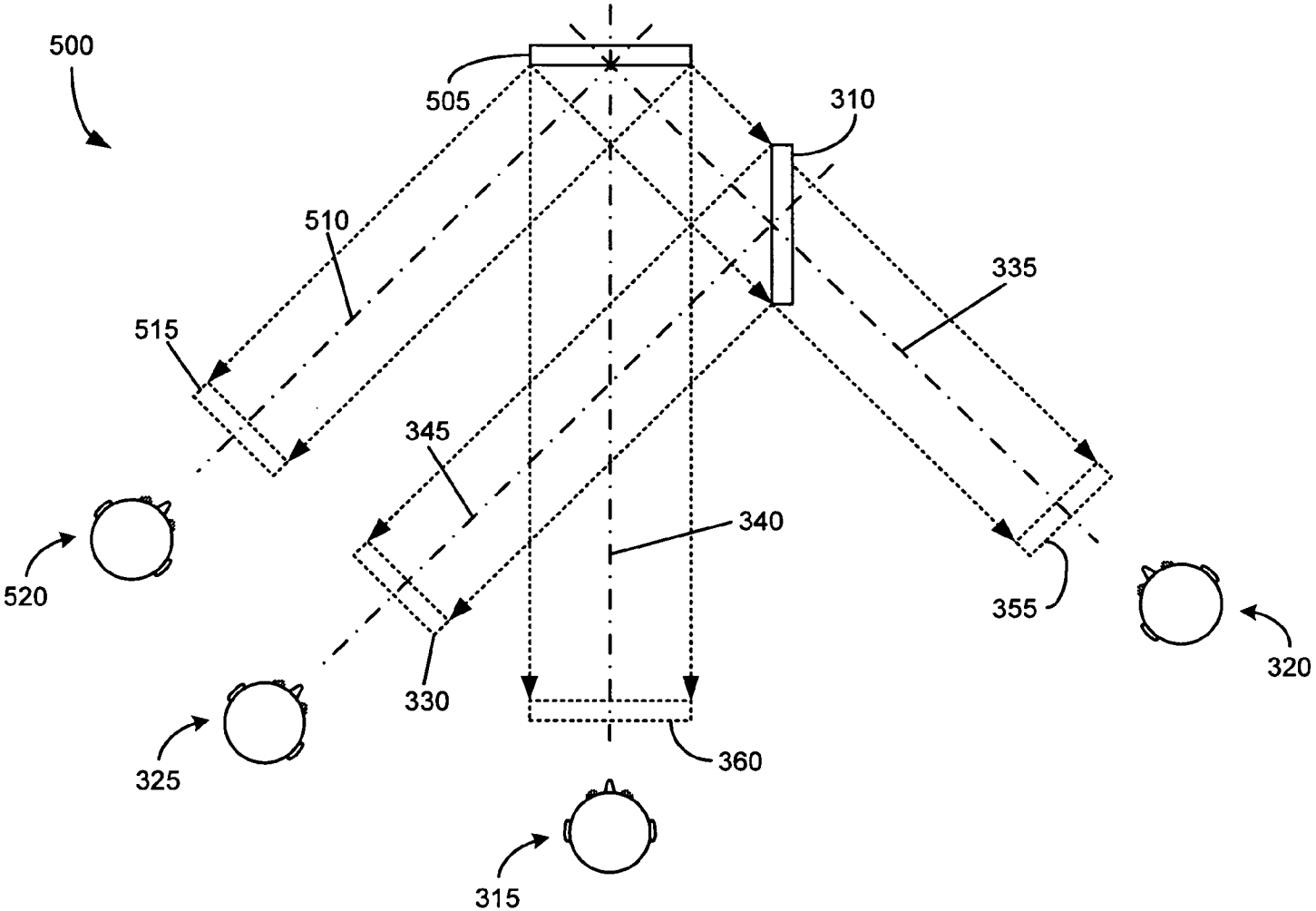
FIG. 5 shows a second exemplary embodiment of a gaming system containing a three-directional display and a one-way mirror, in accordance with the invention.

FIG. 5 shows a gaming system 500 that is a second exemplary embodiment of a gaming system in accordance with the invention. Gaming system 500 includes one-way mirror 310 and a three-directional display 505. Three-directional display 505 is configured to generate three images that are independently viewable by at least three different people.

As described above, light corresponding to the first image travels along central viewing axis 340 towards first person 315 while light corresponding to the second image travels along a first angular viewing axis 335 towards second person 320. As described above using FIG. 4, one-way mirror 310 is positioned transversely to first angular viewing axis 335 such that a first portion of light corresponding to the second image is reflected along second angular viewing axis 345 towards third person 325. The remaining portion of light corresponding to the second image propagates through one-way mirror 310 and continues to travel along first angular viewing axis 335 towards second person 320.

Additionally, light corresponding to the third image travels along a third angular viewing axis 510 towards a fourth person 520. In one exemplary application, fourth person 520 is seated beside third person 325. In this particular application, third person 325 sees a reflection of the second image projected by three-directional display 505, while fourth person 520 directly sees the third image 515 projected by three-directional display 505. As can be understood the second and third images may be identical or independent of one another as described above. It will be further understood, that one or more of the first, second, third, and fourth persons may be game players, observers, or passersby.

Figure 6:
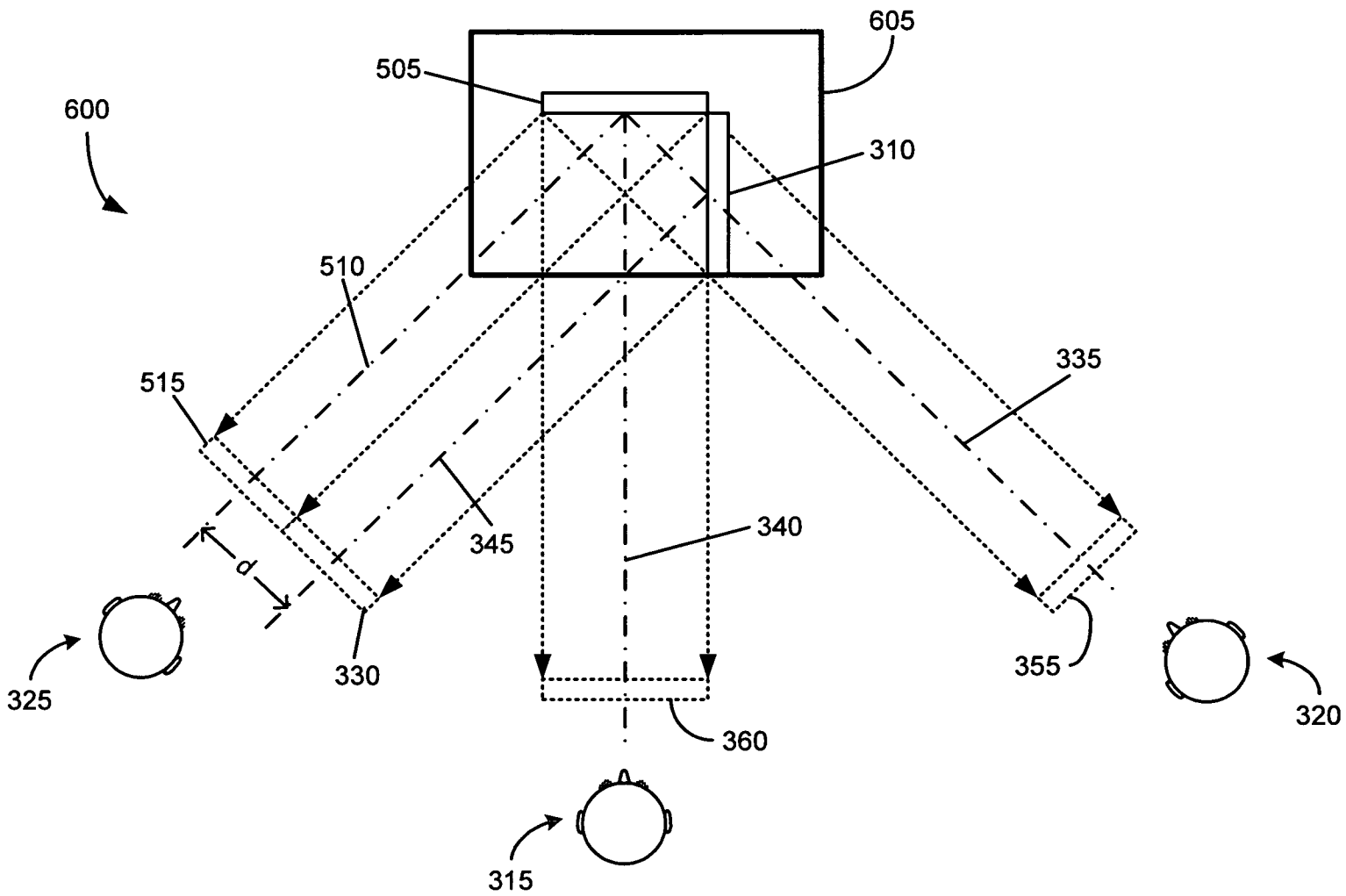
FIG. 6 shows a third exemplary embodiment of a gaming system containing a three-directional display and a one-way mirror, in accordance with the invention.

FIG. 6 shows a gaming system 600 that is a third exemplary embodiment of a gaming system in accordance with the invention. Gaming system 600 includes one-way mirror 310 and three-directional display 505 housed in a gaming cabinet 605. One-way mirror 310 is positioned orthogonal to three-directional display 505 such that light corresponding to the second image generated by three-directional display 505 is propagated along second angular viewing axis 345, towards third person 325. As described above, light corresponding to the third image generated by three-directional display 505 is propagated directly along third angular viewing axis 510. However, in this exemplary embodiment, the positioning of one-way mirror 310 is selected for providing a separation distance 'd' between the two axes 510 and 345 such that third person 325 can directly view the third image, together with the reflected portion of the second image. Consequently, this configuration permits projection of a concatenated image towards third person 325.

The concatenated image may be two images that are independent of each other or may contain image content that is common to the two images. As can be appreciated, a concatenated image constitutes a wider, panoramic view than a single image. Furthermore, the concatenated image allows for dynamic sharing of image content thereby leading to moving images spanning a wider field of view. For example, the image of a car can traverse from a left vertical edge of the first image to the right vertical edge of the second image, thereby providing movement across a field of view that encompasses two images.

Figure 7:
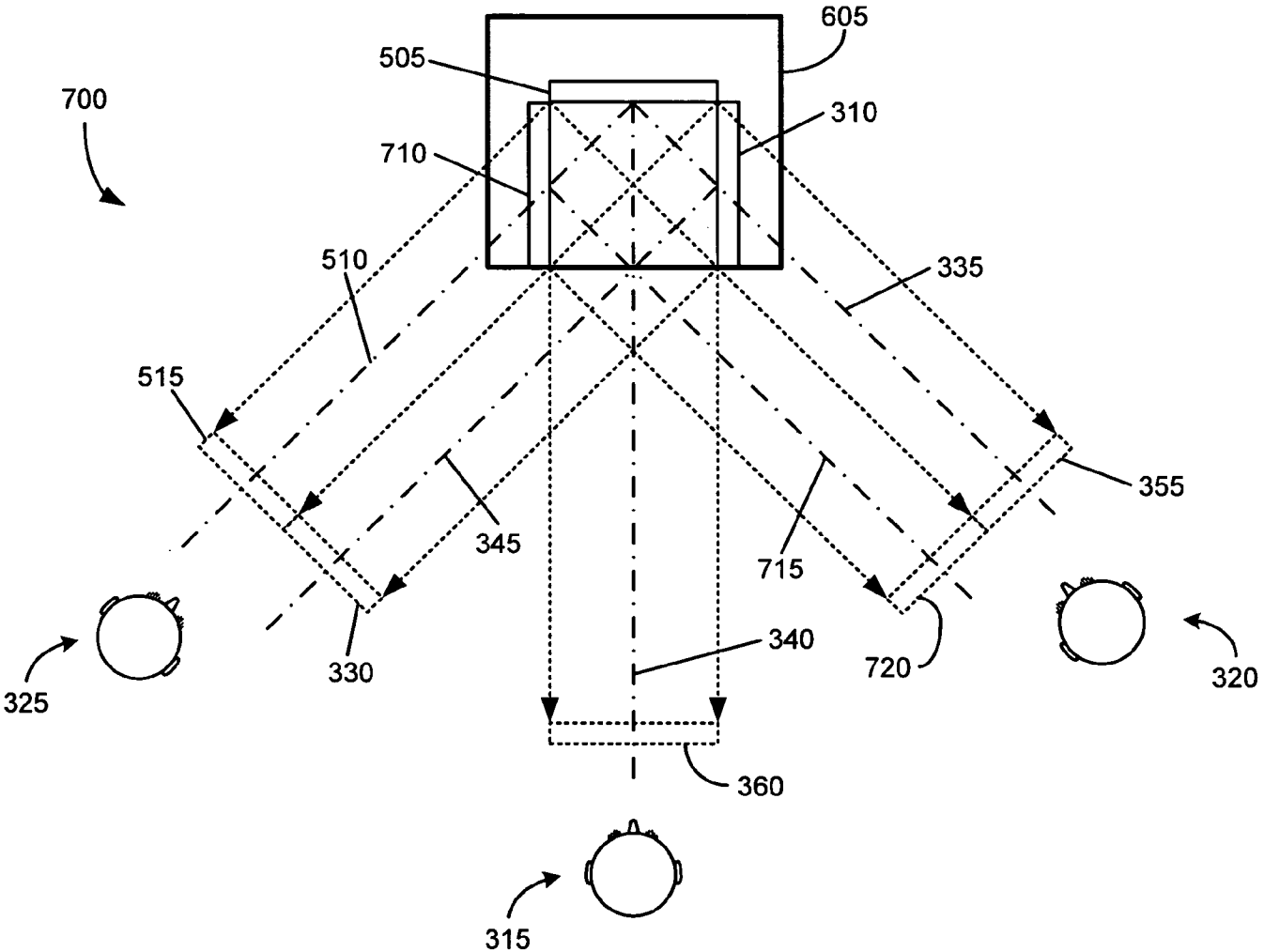
FIG. 7 shows a fourth exemplary embodiment of a gaming system containing a three-directional display and two one-way mirrors, in accordance with the invention.

FIG. 7 shows a gaming system 700 that is a fourth exemplary embodiment of a gaming system in accordance with the invention. Gaming system 700 includes one-way mirror 310 and three-directional display 505 housed in gaming cabinet 605. The operation and configuration of a three-directional display 505 coupled to a single one-way mirror 310 has been described above using FIG. 5. However, in gaming system 700, a second one-way mirror 710 is used in addition to the first one-way mirror 310. Second one-way mirror 710 reflects a portion of light traveling along third angular viewing axis 510, towards second person 325. This reflected light propagates along a fourth angular viewing axis 715. In a manner similar to that described above with reference to one-way mirror 310 (shown in FIG. 6), one-way mirror 710 is also positioned so as to provide a concatenated image (images 720 and 355) that is viewable by second person 320. Consequently, gaming system 700 permits two persons (second person 320 and third person 325) to view two concatenated images. If so desired, image re-orientation elements may be suitably added to portions of each of the two concatenated images. As can be further understood, first person 315 independently views the first image of three-directional display 505 using light traveling along the central viewing axis 340.

Figure 8:
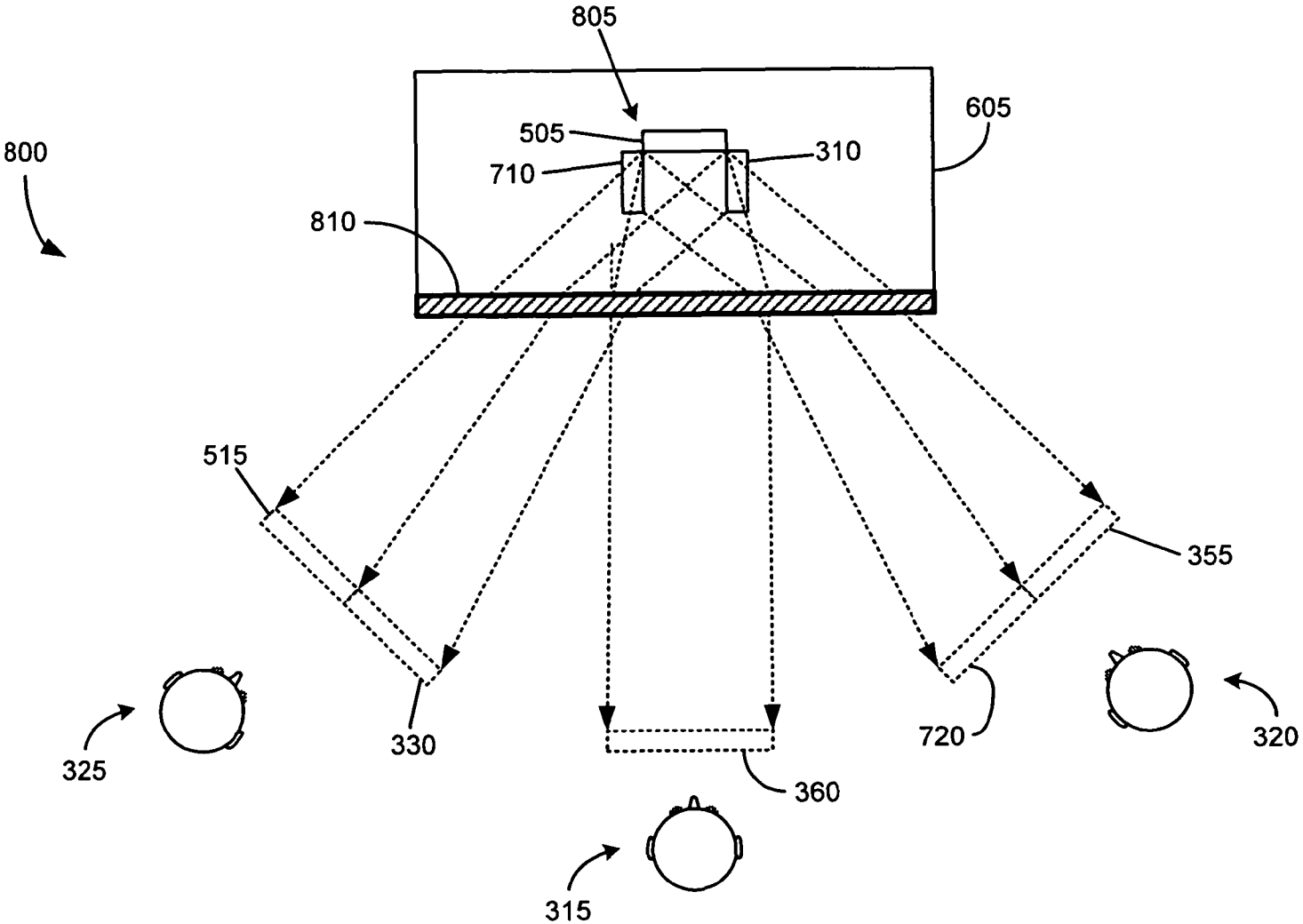
FIG. 8 shows a fifth exemplary embodiment of a gaming system incorporating a lens system in accordance with the invention.

FIG. 8 shows a gaming system 800 that is a fifth exemplary embodiment of a gaming system in accordance with the invention. Gaming system 800 includes an image projection arrangement 805 containing one-way mirror 310, one-way mirror 710, and three-directional display 505. Gaming system 800 additionally includes an optical lens system 810 located between image projection arrangement 805 and one or more persons viewing one or more images generated by three-directional display 505. In one exemplary embodiment, optical lens system 810 is mounted in a front panel of gaming cabinet 605. In another exemplary embodiment, optical lens system 810 is housed inside gaming cabinet 605, behind the front panel of gaming cabinet 605.

Various optical elements can be used to implement optical lens system 810. As one example, optical lens system 810 is implemented using a Fresnel lens panel. As a further example, three individual optical lenses may be used. In operation, optical lens system 810 provides optical magnification and/or image inversion upon the three images projected by three-directional display 505. In the exemplary embodiment shown in FIG. 8, optical lens system 810 simultaneously provides optical magnification and/or image inversion upon all three images. However, optical lens system 810 may be suitably adapted to provide optical magnification and/or image inversion upon selected portions of each of the three individual images or upon entire individual images.

It will be understood that various permutations and combinations of the various configurations described above may be used in various embodiments of gaming system 800. For example, three-directional display 505 may be replaced by two-directional display 305 and/or one or both the one-way mirrors may be eliminated.

Figure 9:
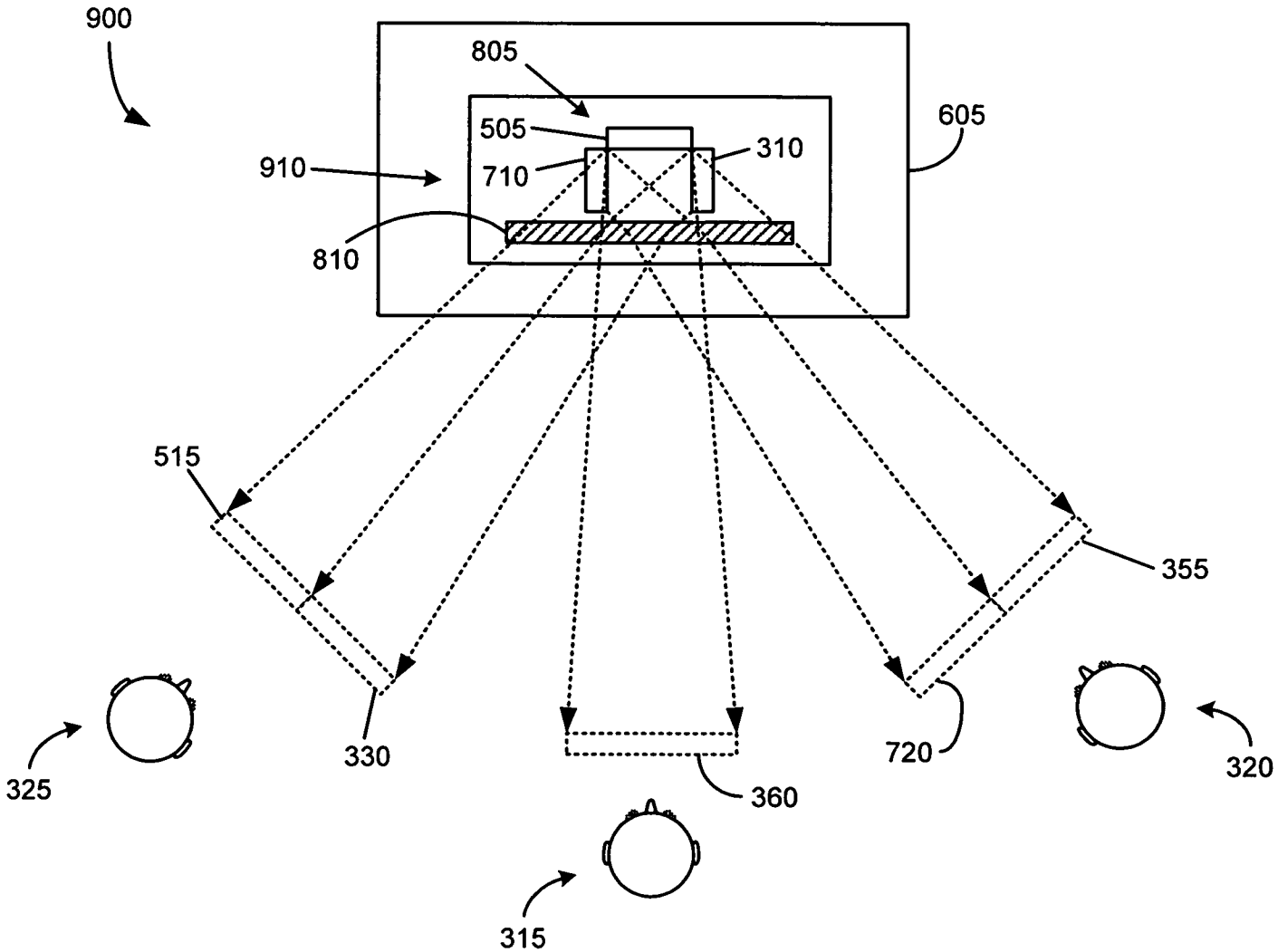
FIG. 9 shows a sixth exemplary embodiment of the gaming system packaged as a modular component in accordance with the invention.

FIG. 9 shows a gaming system 900 that is a sixth exemplary embodiment of a gaming system in accordance with the invention. Gaming system 900 includes optical lens system 810 and image projection arrangement 805 housed inside a modular assembly 910. Modular assembly 910 is a prefabricated component that may be conveniently mounted inside gaming cabinet 705 during manufacture of gaming system 900. Such a prefabricated component provides several advantages. For example, the optical elements contained inside modular assembly 910 are protected against contamination and optical misalignment during the assembly process when manufacturing gaming system 900.

Figure 10:
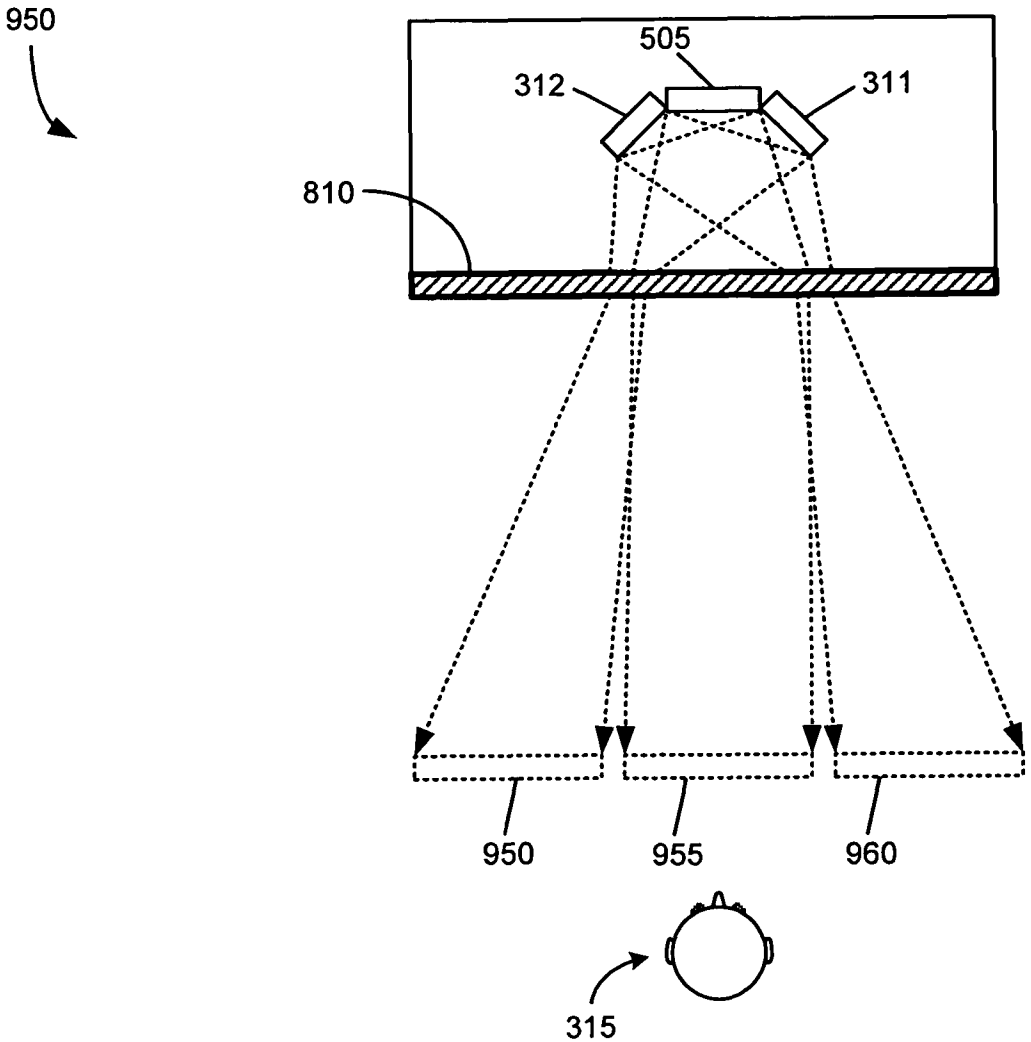
FIG. 10 shows a seventh exemplary embodiment of the gaming system adapted to present three images to a single game player, in accordance with the invention.

FIG. 10 shows a gaming system 950 that is a seventh exemplary embodiment of a gaming system in accordance with the invention. Gaming system 950 includes a first mirror 311, a second mirror 312, and three-directional display 505. Unlike several embodiments described above, mirrors 311 and 312 are not one-way mirrors. In this embodiment, the angular orientation of each of the two mirrors is set such that first person 315 can view all three images simultaneously. At least two of the three images may share common image content. This may be carried out, for example, by providing a dynamic collage of images that move from one screen on to an adjacent screen. In a gaming environment, this dynamic collage may be part of a motor car race for example, with a car moving from one screen on to the next, thereby effectively traveling across the three views encompassing a wide field of vision of first person 315. Thus, gaming system 950 provides, in this exemplary application, a panoramic view (either static or dynamic) that extends three images wide (images 950, 955, and 960). Optical lens system 810 may be optionally used for optical magnification purposes. Correction of image orientation reversal due to reflection from each of the two mirrors may be suitably overcome by driving three-directional display 505 with suitable electrical signals that activate the appropriate image pixels of the second and third images to provide laterally-inverted images prior to reflection by each of the mirrors.

Figure 11:
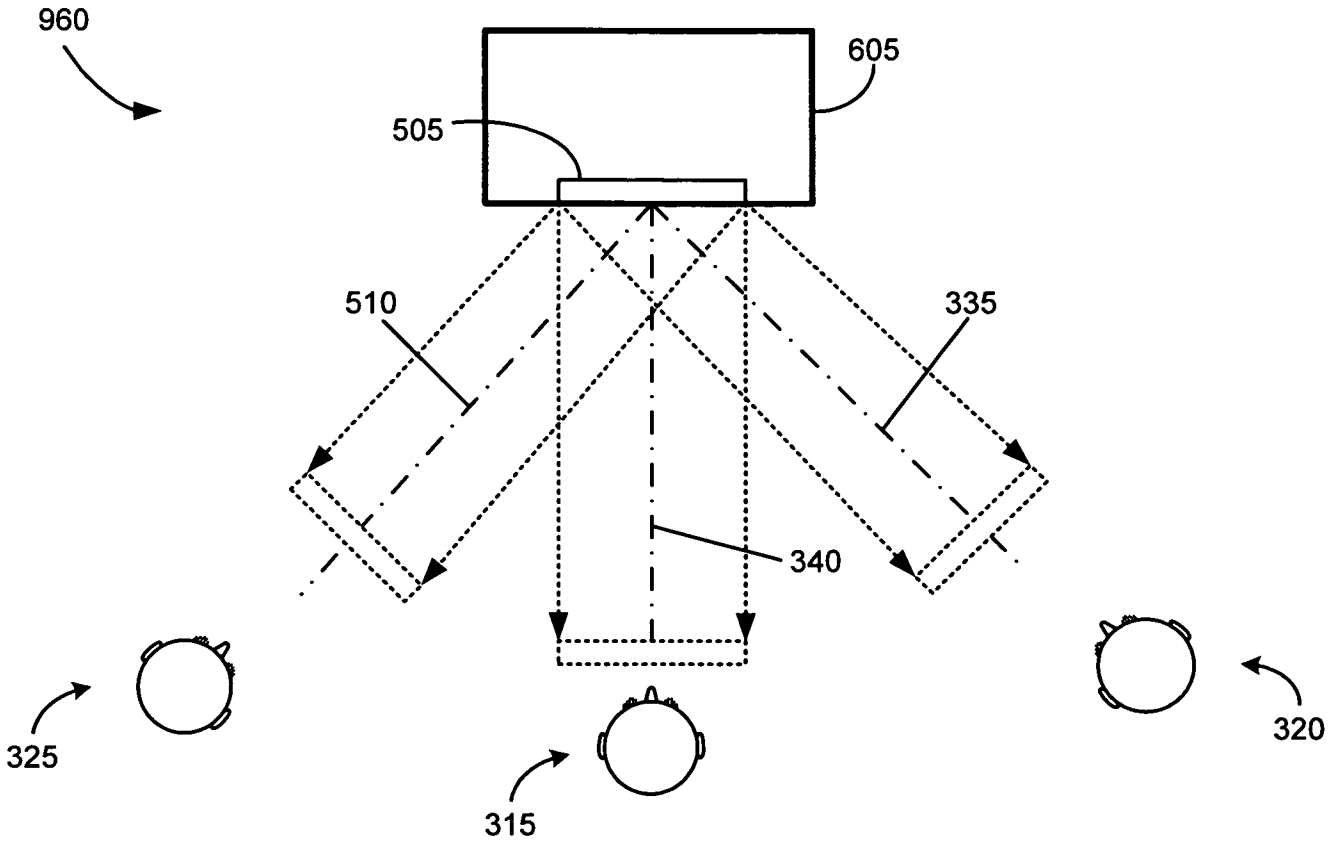
FIG. 11 shows a eighth exemplary embodiment of the gaming system configured as a multi-player system in accordance with the invention.

FIG. 11 shows a gaming system 960 that is an eighth exemplary embodiment of a gaming system in accordance with the invention. In this embodiment no mirrors are used. Gaming system 960 is operable as a multi-player gaming system with the three images produced by three-directional display 505 being interlinked in various ways. Here again, the first image is viewable by first person 315, the second image by second person 320, and the third image by third person 325. For purposes of convenience, the description below will be carried out using only the first and second images. However, it will be understood that the description is equally applicable to any permutations or combinations of two or more of the three images.

In a first exemplary application, the first image is identical to the second image at a first instance in time. For example, both images may pertain to a video game menu or to results of a gaming session. At other instances in time, the two images are different from each other and are privately viewable by each game player. For example, such images are appropriate for a game of bridge where a player's cards must be kept secret from the other player.

In a second exemplary application, the first image is wholly or partially displayed along with the second image. Consequently, for example, first person 315 may be able to watch a portion (or the entire) second image that is being viewed by second person 320 and vice-versa. This merging of images may be carried out using several alternative methods.

In a first exemplary method, a portion of the first image is inserted into the second image. For example, in a car racing game, a car that is being operated by first person 315 may be shown beside another car operated by second person 320, so that second person 320 may view the relative positions of the two cars.

In a second exemplary method, the images are displayed in a video frame format such as used for television. In this mode of operation, a first image is displayed to second person 320 in a first frame that is followed by a second frame wherein the second image is displayed. Alternatively, a first set of images is displayed to second person 320 in a first set of frames that is then followed by a second set of frames containing a second set of images. Either one of these modes of operation is referred to herein as a multiplexed frame format.

In a third exemplary method, the first image, wholly or partially, is inserted into the second image in a sub-frame format. A sub-frame is defined herein as a portion of a frame. Consequently, the first image may be viewed in a first sub-frame while the second image may be simultaneously viewed in a second sub-frame with both sub-frames being viewable simultaneously in a single frame.

In a fourth exemplary method, the first image is inserted into the second image in a picture-in-picture (PIP) format such as used for television. However, unlike television, where a PIP image is typically independent of the main image so as to permit simultaneous viewing of two different television channels, in this fourth exemplary method, the content of the PIP image (first image) is related to the content of the main image (second image). For example, the PIP image may provide a comparative display of gaming parameters between two players.

The above-described embodiments are merely set forth for a clear understanding of the principles of the disclosure. Many variations and modifications may be made without departing substantially from the disclosure. All such modifications and variations are included herein within the scope of this disclosure.

I claim:

1. A gaming system for providing a game, comprising:

a multi-directional display configured to display a first visual image and a second visual image associated with the game, the first visual image being viewable along a central viewing axis of the multi-direction display and the second visual image being viewable along a first angular viewing axis relative to said central viewing axis; and a first one-way mirror positioned with reference to the multi-directional display for reflecting the second visual image along a second angular viewing axis relative to said central viewing axis while permitting direct viewing of at least a portion of the second visual image through the first one-way mirror along the first angular viewing axis relative to said central viewing axis, wherein said first visual image is not viewable along the first and second angular viewing axes and said second visual image is not viewable along said central viewing axis.

2. The gaming system of claim 1, wherein the multi-directional display is further configured to display a third visual image associated with the game, the third visual image being viewable along a third angular viewing axis parallel to the second angular viewing axis.

3. The gaming system of claim 1, further comprising:

an optical lens system configured to provide optical magnification upon at least a portion of the second visual image.

4. The gaming system of claim 3, wherein the optical lens is further configured to provide optical magnification upon at least a portion of the first visual image.

5. The gaming system of claim 3, wherein the optical lens comprises a Fresnel lens.

6. The gaming system of claim 1, wherein the first one-way mirror is an adjustable mirror for permitting a game player to selectably position the first one-way mirror with reference to the multi-directional display.

7. A gaming system for providing a game, comprising:

a multi-directional display configured to display along a central viewing axis thereof a first visual image and a second visual image associated with the game, the first visual image being viewable by a game player positioned in front of the gaming system and the second visual image being viewable along an angular viewing axis relative to said central viewing axis and not viewable by the game player positioned in front of the gaming system;

a first mirror configured to reflect the second visual image towards the game player positioned in front of the gaming system; and an optical lens system located between the game player and at least one of the multi-directional display and the first mirror, the optical lens system configured to provide optical magnification upon at least one of the first and the second visual images.

8. The gaming system of claim 7, wherein the multi-directional display is further configured to display a third visual image associated with the game, the third visual image not being viewable by the game player positioned in front of the gaming system.

9. The gaming system of claim 8, further comprising a second mirror configured to reflect the third visual image towards the game player positioned in front of the gaming system.

10. A method for operating a gaming system, the method comprising:

providing a multi-directional display;

displaying on the multi-directional display, a first visual image that is viewable by a first game player positioned in front of the gaming system, the first visual image being associated with a multi-player video game; and displaying on the multi-directional display, a second visual image that is viewable by a second game player sitting on one side of the first game player, wherein the second visual image is not viewable by the first game player, and wherein the second visual image is associated with the multi-player video game.

11. The method of claim 10, further comprising:

displaying at least a portion of the first visual image along with at least a portion of the second visual image integrally merged with each other in a single frame.

12. The method of claim 11, wherein the portions of the first and the second visual images comprise one of a) a menu of the multi-player video game and b) a result of the multi-player video game.

13. The method of claim 10, further comprising:

displaying at least one of the first and second visual images in a sub-frame format.

14. The method of claim 10, further comprising:

displaying the first visual image in a multiplexed frame format together with the second visual image.

15. The method of claim 10, further comprising:

displaying at least one of the first and second visual images in a picture-in-picture format.

16. The method of claim 10, wherein the first visual image is the same as the second visual image, each comprising a marketing image.

17. A method for operating a gaming system that provides a game, the method comprising:

providing a multi-directional display;

displaying on the multi-directional display, a first visual image associated with the game, the first visual image being viewable by a game player positioned along a central viewing axis of the multi-direction display;

displaying on the multi-directional display, a second visual image associated with the game, the second visual image being viewable along a first angular viewing axis relative to said central viewing axis, wherein said first visual image is not viewable along the first angular viewing axis and said second visual image is not viewable along said central viewing axis; and setting the initial orientation of the second visual image generated by the multi-directional display so as to provide a desired orientation of the second visual image after reflection by a mirror.

18. The method of claim 17, further comprising locating the mirror such that a reflection of the second visual image is viewable by a viewer other than the game player.

19. The method of claim 17, wherein setting the initial orientation of the second visual image comprises driving the multi-directional display with an electrical signal for providing image inversion on at least a portion of the second visual image prior to reflection by the mirror.

20. The method of claim 19, wherein providing image inversion comprises establishing a lateral inversion of at least a portion of the second visual image.

* * * * *